US009625848B2

(12) United States Patent
Suzuki et al.

(10) Patent No.: US 9,625,848 B2
(45) Date of Patent: Apr. 18, 2017

(54) TONER AND METHOD FOR PRODUCING TONER

(71) Applicants: Yousuke Suzuki, Shizuoka (JP); Sayaka Yuasa, Hokkaido (JP); Sayuri Kojima, Shizuoka (JP); Takahiro Kadota, Shizuoka (JP); Yasuaki Iwamoto, Shizuoka (JP)

(72) Inventors: Yousuke Suzuki, Shizuoka (JP); Sayaka Yuasa, Hokkaido (JP); Sayuri Kojima, Shizuoka (JP); Takahiro Kadota, Shizuoka (JP); Yasuaki Iwamoto, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/927,733

(22) Filed: Jun. 26, 2013

(65) Prior Publication Data

US 2014/0072911 A1 Mar. 13, 2014

(30) Foreign Application Priority Data

Sep. 7, 2012 (JP) ..... 2012-196923

(51) Int. Cl.

*G03G 9/135* (2006.01)
*G03G 9/08* (2006.01)
*G03G 9/087* (2006.01)

(52) U.S. Cl.

CPC ..... *G03G 9/135* (2013.01); *G03G 9/081* (2013.01); *G03G 9/0804* (2013.01); *G03G 9/08755* (2013.01); *G03G 9/08791* (2013.01); *G03G 9/08797* (2013.01)

(58) Field of Classification Search

CPC ..... G03G 9/08755; G03G 9/08; G03G 9/0802
USPC ..... 430/137.17, 109.4
See application file for complete search history.

(56) References Cited

U.S. PATENT DOCUMENTS

| | | | | |
|---|---|---|---|---|
| 5,985,501 | A | 11/1999 | Sato et al. | |
| 2007/0134576 | A1* | 6/2007 | Sweeney et al. | 430/108.1 |
| 2009/0104555 | A1* | 4/2009 | Wakamatsu et al. | 430/108.22 |
| 2009/0195571 | A1* | 8/2009 | Shimada | 347/6 |
| 2010/0055603 | A1* | 3/2010 | Nozaki et al. | 430/124.1 |
| 2010/0124716 | A1 | 5/2010 | Tomioka et al. | |

FOREIGN PATENT DOCUMENTS

| | | | |
|---|---|---|---|
| JP | 64-013556 | A | 1/1989 |
| JP | 07-152202 | | 6/1995 |
| JP | 07-319205 | | 12/1995 |
| JP | 2537503 | | 7/1996 |
| JP | 10-319624 | | 12/1998 |
| JP | 2004-124059 | A | 4/2004 |
| JP | 2005-173578 | | 6/2005 |
| JP | 2006-227592 | | 8/2006 |
| JP | 2007-127678 | | 5/2007 |
| JP | 2010-128128 | A | 6/2010 |

OTHER PUBLICATIONS

Japanese Office Action dated Sep. 13, 2016, issued in corresponding Japanese Patent Application No: 2012-196923, with English Translation.

Japanese Office Action dated Apr. 26, 2016, issued in corresponding Japanese Patent Application No. 2012-196923, with English translation.

* cited by examiner

*Primary Examiner* — Thorl Chea

(74) *Attorney, Agent, or Firm* — Oblon, McClelland, Maier & Neustadt, L.L.P.

(57) ABSTRACT

A toner, wherein the toner is obtained by washing a toner particle dispersion liquid which is obtained by adding cellulase to a dispersion slurry, and the dispersion slurry is obtained from a dispersion liquid or an emulsion of a toner material-containing oil phase in an aqueous medium, and wherein the dispersion liquid or the emulsion contains a cellulosic dispersion stabilizing agent.

7 Claims, No Drawings

TONER AND METHOD FOR PRODUCING TONER

BACKGROUND OF THE INVENTION

Field of the Invention

The present invention relates to a toner and a method for producing the toner.

Description of the Related Art

The image forming method for, for example, electrophotography, electrostatic recording and electrostatic printing includes a development step in which a toner contained in a developer is attached once to an image bearing member such as photoconductor on which a static charge image is formed, a transferring step in which the toner is transferred from the photoconductor to a transfer medium such as transfer paper, and a fixing step in which the toner is fixed on the paper.

Known developers are classified into the following two types: a two-component developer containing a magnetic carrier and a toner, and a one-component developer without the magnetic carrier (a magnetic toner or a non-magnetic toner).

In recent years, there has been increasingly a demand for higher quality images, and in particular, to realize forming a high-precision color image, small sizing and spheroidizing of the toner are under way. The small sizing enables excellent dot-reproductivity, and the spheroidizing makes it possible to improve developing properties and transferring properties.

In order to provide such a small-sized toner, in recent years, many methods for producing a toner in which toner particles are granulated in liquid have been proposed such as polymerization methods (e.g., a suspension polymerization method, an emulsion polymerization method, and a dispersion polymerization method). In the polymerization methods, upon forming the toner particles, the toner particles are polymerized in a medium to which a surfactant and a dispersion stabilizing agent have been added in order to control the particle diameter or the shape of the toner particles.

However, in the case where the surfactant and the dispersion stabilizing agent remain in the thus produced toner, the toner is adversely affected in chargeability, i.e., the toner is lowered in charge and resistance. Especially, the toner is greatly adversely affected under a high temperature and high humidity condition. Examples of known dispersion stabilizing agents include a water-soluble polymeric material which forms a protective colloid phase to thereby mainly prevent particles from coalescing with each other and from precipitating; and a poorly water-soluble inorganic compound which mainly generates electrostatic repulsion for dispersion stabilization.

For example, Japanese Patent Application Laid-Open (JP-A) No. 2007-127678 describes a use of a poorly water-soluble inorganic compound colloid because a water-soluble polymeric material has the following disadvantages. Firstly, the water-soluble polymeric material adhered onto the surfaces of polymeric particles is difficult to be removed by a work-up such as a post-polymerization washing. In addition, upon polymerizing the polymeric particles, fine particles having particle diameters of sub-micron level are by-produced besides intended polymeric particles. Therefore, upon filtering off the polymeric particles from an aqueous medium, a filter medium is clogged with some free fine particles, which lowers a filtration rate and thus production efficiency.

JP-A No. 07-152202 discloses a method for obtaining toner particles as follows. An oil phase (organic solvent liquid) is obtained by dissolving or dispersing a toner material containing a polyester resin and a colorant in a solvent in which the polyester resin can be dissolved. Then, the oil phase is dispersed in an aqueous medium containing an inorganic dispersing agent, followed by granulating. Finally, the inorganic dispersing agent is washed off with hydrochloric acid to thereby obtain toner particles.

JP-A No. 07-319205 discloses a method for obtaining toner particles as follows. At first, a resin suspension liquid is obtained by adding a colored resin solution containing a toner material to an aqueous dispersion liquid containing an inorganic dispersing agent. Then, the resin suspension liquid is desolvated. Concentrated sulfuric acid is added thereto to thereby dissolve the inorganic dispersing agent. The resultant toner is washed by adding to deionized water and stirring until conductivity thereof becomes 1 μmS/cm to 100 μmS/cm. However, in the above method, only dispersion stabilizing agents remaining in the close proximity to the surfaces of the toner particles are removed. That is, the dispersion stabilizing agents remaining inside the toner particles are removed incompletely, which is insufficient to maintain chargeability over a long period of time.

JP-A No. 10-319624 proposes a method for obtaining toner particles as follows. Toner particles are washed with water, and then redispersed into washing water. Then the toner particles are heated to a temperature equal to or higher than the glass transition temperature of a resin contained in toner particles, stirred, and washed. Thus, a solution of the toner particles having electroconductivity of 100 μs or less and surface tension of 20 mN or more is obtained.

The above proposed technique focused on that a change of toner chargeability under a high temperature and high humidity environment depends on a trace amount of ion remaining on the surfaces of the toner particles which is unavoidably occurred in the manufacturing process. Based on that, deionized water was used for washing off the dispersion stabilizing agent and the surfactant after granulation, and water-washing was performed until the amount of ion components such as a halogen ion and a sodium ion remaining on the surfaces of the toner particles is decreased to fall within a predetermined range. It was argued that the above technique allowed the obtained toner to maintain excellent chargeability even after a long-term storage under a high temperature and high humidity environment. However, the technique is still insufficient in that the dispersion stabilizing agents remaining inside the toner particles cannot be removed. Additionally, when once-formed toner base particles are heated in liquid to a temperature equal to or higher than the glass transition temperature, undesired results are generated such as a deformation of the particles or a change of the particle diameter.

JP-A No. 2006-227592 discloses that a washing end point cannot be determined unless ion-exchanged water is increased in temperature to the temperature equal to or higher than the glass transition temperature of a binder resin. As such, the surfactant and the dispersion stabilizing agent are very difficult to be removed.

On the other hand, JP-A No. 2005-173578 discloses a use of a water-soluble polymeric material as the dispersion stabilizing agent. However, the water-soluble polymeric material is not used at a granulation step prior to a desolvation, but used at a deformation step after producing toner particles.

SUMMARY OF THE INVENTION

The present invention aims to provide a toner having excellent chargeability stably over a long period of time and a method for efficiently producing the toner.

The present inventors conducted extensive studies to achieve the above objects, and have found that a cellulosic dispersion stabilizing agent can stably disperse toner material-containing droplets and has extremely high hydrophilicity and relatively high molecular weight (i.e., low mobilability) relative to that of other low molecular materials such as a surfactant. As a result, the cellulosic dispersion stabilizing agent tends to be present in an aqueous phase and is difficult to be incorporated into an oil phase. Although there is a disadvantage that the cellulosic dispersion stabilizing agent relatively tends to remain on the surfaces of toner base particles upon a solid-liquid separation of the toner base particles, this disadvantage has been solved in the present invention by using a enzymatic hydrolysis in order to increase the number of hydrophilic groups which can be easily washed and decrease the molecular weight.

Accordingly, the cellulosic dispersion stabilizing agent can be easily removed even when adhered onto the toner particles by washing after treating with cellulase. In addition, the cellulosic dispersion stabilizing agent can improve production efficiency because a filter media is not clogged when filtering off the toner particles from an aqueous medium.

A toner of the present invention, which is a means for solving the above problems, is a toner obtained by washing a toner particle dispersion liquid which is obtained by adding cellulase to a dispersion slurry, the dispersion slurry being obtained from a dispersion liquid or an emulsion of a toner material-containing oil phase in an aqueous medium, and wherein the dispersion liquid or the emulsion contains a cellulosic dispersion stabilizing agent.

According to the present invention, a toner having excellent chargeability stably over a long period of time is provided. In addition, a method for efficiently producing the toner is provided.

DETAILED DESCRIPTION OF THE INVENTION (Toner)

A toner of the present invention is a toner obtained by washing a toner particle dispersion liquid which is obtained by adding cellulase to a dispersion slurry, the dispersion slurry being obtained from a dispersion liquid or an emulsion of a toner material-containing oil phase in an aqueous medium, and wherein the dispersion liquid or the emulsion contains a cellulosic dispersion stabilizing agent.

The reason why the toner of the present invention has excellent chargeability stably over a long period of time has not been revealed. However, it is believed because the washing which is performed after the cellulase is added to the dispersion slurry results in an enzymatic degradation of the cellulosic dispersion stabilizing agent and a viscosity lowering of the toner particle dispersion liquid before the washing. Therefore, the toner particle dispersion liquid can be washed thoroughly without uneven washing performance, and a charge leaking substance such as a surfactant and a dispersion stabilizing agent can be cleaned efficiently.

<Dispersion Stabilizing Agent>

In the present invention, the aqueous medium contains a dispersion stabilizing agent in order to stabilize dispersed droplets, which allows a shape and a particle diameter of toner particles to be controlled and results in a toner having a sharp particle size distribution.

A cellulosic dispersion stabilizing agent is used as the dispersion stabilizing agent.

The cellulosic dispersion stabilizing agent preferably contains a negatively charged monomer component because the cellulosic dispersion stabilizing agent is also negatively charged. When a toner material such as polyester is used as the cellulosic dispersion stabilizing agent, it does not enter droplets of the toner material upon polymerizing, so that it does not remain inside the toner particles.

Examples of the cellulosic dispersion stabilizing agent include methylcellulose, hydroxyethylcellulose, hydroxypropylcellulose, and carboxymethylcellulose. These may be used alone or in combination.

The amount of the cellulosic dispersion stabilizing agent depends on a toner material used, and an intended shape and particle size distribution of a toner, but is preferably 0.01% by mass to 1% by mass relative to the total amount of an aqueous medium.

<Cellulase>

The cellulase is an enzyme which hydrolyzes a glycosidic linkage in a cellulose chain.

The cellulase decomposes the cellulosic dispersion stabilizing agent to thereby lower the viscosity of the toner particle dispersion liquid, which makes the toner particles to be easily washed and improves production efficiency because a filtration speed does not lower when filtering off the toner particles from the aqueous medium.

The cellulase is commercially available in the form of a mixture containing a cellulase component. Example thereof include CELLULIZER ACE (product of Nagase ChemteX Co., Ltd.), CELLULIZER HT (product of Nagase ChemteX Co., Ltd.), CELLULIZER CL (product of Nagase ChemteX Co., Ltd.), PRIMA FIRST (product of Genencor Kyowa Co. Ltd.), INDIAGENEWTRAFLEX (product of Genencor Kyowa Co. Ltd.), GODO-TCL (product of GODO SHUSEI CO., LTD.), GODO-TCD-H3 (product of GODO SHUSEI CO., LTD.), SUPER THERMOSTABLE CELLULASE (product of Thermostable Enzyme Laboratory, Co., Ltd.), VARIDASE ANC40 (product of DSM Japan, Ltd.), CELLSOFT (product of Novozymes, Japan Ltd.), ENTIRON CM (product of RAKUTO KASEI INDUSTRIAL CO., LTD.) and BIOHIT (product of RAKUTO KASEI INDUSTRIAL CO., LTD.). These may be used alone or in combination. Notably, other enzymes can be used in combination.

<Binder Resin>

The binder resin is preferably a polyester resin from the viewpoints of fixability and heat-resistant storage ability. In addition, a small amount of vinyl copolymer resin can be added from the viewpoints of easiness in designing of resin properties such as thermal property or polarity, and of easiness in copolymerizing polymerizable monomers having special functional groups.

<<Polyester Resin>>

The polyester resin includes polycondensates formed between polyols (1) and polycarboxylic acids (2) listed below. Any polyester resin may be used and some polyester resins may be mixed.

—Polyol—

Examples of the polyol (1) include alkylene glycols (e.g., ethylene glycol, 1,2-propylene glycol, 1,3-propylene glycol, 1,4-butanediol, and 1,6-hexanediol); alkylene ether glycols (e.g., diethylene glycol, triethylene glycol, dipropylene glycol, polyethylene glycol, polypropylene glycol, and polytetramethylene ether glycol); alicyclic diols (e.g., 1,4-cyclohexane dimethanol and hydrogenated bisphenol A); bisphenols (e.g., bisphenol A, bisphenol F, and bisphenol S), 4,4'-dihydroxyphenyls (e.g., 3,3'-difluoro-4,4'-dihydroxybiphenyl); bis(hydroxyphenyl)alkanes (e.g., bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (also known as tetrafluorobisphenol A), and 2,2-bis(3-hydroxyphenyl)-1,1,1,3,3,3-hexafluoropropane); bis(4-hydroxyphenyl)ethers (e.g., bis(3-fluoro-4-hydroxyphenyl) ether); adducts of the above-mentioned alicyclic diols with an alkylene oxide (e.g., ethylene oxide, propylene oxide, or butylene oxide); and adducts of the above-mentioned bisphenols with an alkylene oxide (e.g., ethylene oxide, propylene oxide, or butylene oxide).

Among them, alkylene glycols having 2 to 12 carbon atoms and adducts of a bisphenol with an alkylene oxide are preferred. Adducts of a bisphenol with an alkylene oxide, or a mixture of such an adduct and an alkylene glycol having 2 to 12 carbon atoms is more preferred.

Other examples include trihydric to octahydric or higher polyhydric aliphatic alcohols (e.g., glycerin, trimethylolethane, trimethylolpropane, pentaerythritol, and sorbitol); trihydric or higher phenols (e.g., trisphenol PA, phenol novolac, and cresol novolac); and adducts of the above-mentioned trihydric or higher polyphenols with an alkylene oxide.

Notably, the above-mentioned polyols can be used alone or in combination, and are not limited to what is listed above.

—Polycarboxylic Acid—

Examples of the polycarboxylic acid (2) include alkylene dicarboxylic acids (e.g., succinic acid, adipic acid, and sebacic acid), alkenylene dicarboxylic acids (e.g., maleic acid and fumaric acid), and aromatic dicarboxylic acids (e.g., phthalic acid, isophthalic acid, terephthalic acid, naphthalene dicarboxylic acid, 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl)hexafluoropropane, 2,2-bis(3-carboxyphenyl)hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, and hexafluoroisopropylidene diphthalic anhydride).

Among them, alkenylene dicarboxylic acids having 4 to 20 carbon atoms, and aromatic dicarboxylic acids having 8 to 20 carbon atoms are preferred.

An aromatic polycarboxylic acid having 9 to 20 carbon atoms (e.g., trimellitic acid or pyromellitic acid), or an acid anhydride or a lower alkyl ester (e.g., a methyl ester, ethyl ester, or isopropyl ester) of the above, can be used as a trivalent or higher polycarboxylic acid to react with the polyol (1).

The polycarboxylic acids can be used alone or in combination, and are not limited to what is listed above.

The ratio of the polyol (1) to the polycarboxylic acid (2), as the equivalence ratio [OH]/[COOH] of hydroxyl groups [OH] to carboxyl groups [COOH], is preferably 2/1 to 1/1, more preferably 1.5/1 to 1/1, further preferably 1.3/1 to 1.02/1.

The peak molecular weight of the polyester resin is not particularly limited and may be appropriately selected depending on the intended purpose. It is preferably 1,000 to 30,000, more preferably 1,500 to 10,000, further preferably 2,000 to 8,000. When the peak molecular weight is less than 1,000, heat resistance may be degraded, but when it is more than 30,000, low-temperature fixability may be degraded.

<Modified Polyester Resin>

The binder resin in a core portion used in the present invention may contain a modified polyester resin having a urethane and/or urea group for adjusting the viscoelasticity, for example, in order to prevent offset.

The amount of the modified polyester resin having a urethane and/or urea group contained in the binder resin is preferably 20% by mass or less, more preferably 15% by mass or less, further preferably 10% by mass or less. When the amount is more than 20% by mass, low-temperature fixability may be degraded.

The modified polyester resin having a urethane and/or urea group may be directly mixed with the binder resin. However, from the viewpoint of productivity, the modified polyester resin having a urethane and/or urea group is preferably formed by mixing the binder resin with a modified polyester resin having a relatively low molecular weight and having a terminal isocyanate group (hereinafter may be referred to as "prepolymer") and amines reactive with the prepolymer, and then subjecting to a chain elongation or crosslinking reaction during or after a granulation. By doing so, it becomes easy to incorporate into the core portion the modified polyester resin having a relatively high molecular weight for adjusting the viscoelasticity.

—Prepolymer—

Examples of the prepolymer having an isocyanate group include those obtained by subjecting the polyol (1) and the polycarboxylic acid (2) to polycondensation to thereby obtain a polyester having active hydrogen groups, and then reacting this with a polyisocyanate (3).

Examples of the above active hydrogen groups the polyester has include hydroxyl groups (alcoholic hydroxyl groups and phenolic hydroxyl groups), amino groups, carboxyl groups, and mercapto groups. Among them, alcoholic hydroxyl groups are preferred.

—Polyisocyanate—

Examples of the polyisocyanate (3) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocyanates (e.g., tolylene diisocyanate and diphenylmethane diisocyanate); aromatic aliphatic diisocyanates (e.g., $\alpha,\alpha,\alpha',\alpha'$-tetramethyl xylylene diisocyanate); isocyanurates; those in which the above polyisocyanates are blocked with a phenol derivative, an oxime, or a caprolactam; and combinations of the two or more thereof.

The ratio of the polyisocyanate (3), as the equivalence ratio [NCO]/[OH] of isocyanate groups [NCO] to hydroxyl groups [OH] of the polyester having hydroxyl groups, is preferably 5/1 to 1/1, more preferably 4/1 to 1.2/1, further preferably 2.5/1 to 1.5/1. When the [NCO]/[OH] is more than 5, low-temperature fixability may be degraded, but when the [NCO]/[OH] is less than 1, the urea content in the modified polyester is so low that hot offset resistance may be degraded.

The amount of the polyisocyanate (3) contained in the prepolymer having a terminal isocyanate group (A) is preferably 0.5% by mass to 40% by mass, more preferably 1% by mass to 30% by mass, further preferably 2% by mass to 20% by mass. When the amount is less than 0.5% by mass, offset resistance may be degraded. When the amount is more than 40% by mass, low-temperature fixability may be degraded.

The number of isocyanate groups contained per molecule of the prepolymer having an isocyanate group (A) is preferably 1 or more, more preferably 1.5 to 3 on average, further preferably 1.8 to 2.5 on average.

When the number is less than 1 per molecule, the molecular weight of the modified polyester is lowered after a chain elongation and/or crosslinking, and offset resistance may be degraded.

In the present invention, amines can be used as a chain elongation agent and/or crosslinking agent.

Examples of the amines (B) include diamines (B 1), trivalent or higher polyamines (B2), amino alcohols (B3), amino mercaptans (B4), amino acids (B5), and those obtained by blocking amino groups contained in B1 to B5 (B6).

Examples of the diamines (B1) include aromatic diamines (e.g., phenylenediamine, diethyltoluenediamine, 4,4'-diaminodiphenylmethane, tetrafluoro-p-xylylenediamine, and tetrafluoro-p-phenylenediamine); alicyclic diamines (e.g., 4,4'-diamino-3,3'-dimethyldicyclohexylmethane, diaminocyclohexane, and isophoronediamine); and aliphatic diamines (e.g., ethylenediamine, tetramethylenediamine, hexamethylenediamine, dodecafluorohexylenediamine and tetracosafluorododecylene diamine).

Examples of the trivalent or higher polyamines (B2) include diethylenetriamine and triethylenetetramine.

Examples of the amino alcohols (B3) include ethanolamine, and hydroxyethyl aniline.

Examples of the amino mercaptans (B4) include aminoethyl mercaptan and aminopropyl mercaptan.

Examples of the amino acids (B5) include aminopropionic acid and aminocaproic acid.

Examples of those obtained by blocking amino groups contained in (B1) to (B5) (B6) include ketimine compounds and oxazoline compounds obtained from the amines B1 to B5 and ketones (e.g., acetone, methyl ethyl ketone, or methyl isobutyl ketone).

If necessary, the molecular weight of the modified polyester resin after completion of the reaction can be adjusted using a reaction terminating agent for a chain elongation and/or crosslinking reaction.

Examples of the terminating agent include monoamines (e.g., diethylamine, dibutylamine, butylamine, and laurylamine) and blocked products thereof (ketimine compounds).

The ratio of the amines (B), as the equivalence ratio [NCO]/[NHx] of isocyanate groups [NCO] in the prepolymer having an isocyanate group (A) to amino groups [NHx] in the amines (B), is preferably 1/2 to 2/1, more preferably 1.5/1 to 1/1.5, further preferably 1.2/1 to 1/1.2. When the [NCO]/[NHx] is greater than 2 or less than ½, the molecular weight of a urea-modified polyester (i) is lowered, and thus hot offset resistance may be degraded.

<<Colorant>>

The colorant is not particularly limited and any known dyes and pigments can be used. Examples thereof include carbon black, Nigrosine dyes, black iron oxide, Naphthol Yellow S, Hansa Yellow (10G, 5G, and G), Cadmium Yellow, yellow iron oxide, loess, chrome yellow, titanium yellow, polyazo yellow, Oil Yellow, Hansa Yellow (GR, A, RN, and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, para-chloro-ortho-nitroaniline red, Lithol Fast Scarlet G, Brilliant Fast Scarlet, Brilliant Carmine BS, Permanent Red (F2R, F4R, FRL, FRLL, and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarin Lake, Thioindigo Red B, Thioindigo Maroon, Oil Red, Quinacridone Red, Pyrazolone Red, polyazo red, Chrome Vermilion, Benzidine Orange, Perinone Orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, and mixtures thereof. These may be used alone or in combination.

The amount of the colorant contained in the toner is not particularly limited and may be appropriately selected depending on the intended purpose, but is preferably 1% by mass to 15% by mass, more preferably 3% by mass to 10% by mass.

The colorant may be mixed with a resin to form a masterbatch.

Examples of the binder resin which is used for producing the masterbatch or which is kneaded together with the masterbatch include the above-described modified or unmodified polyester resins; styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalenecopolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl $\alpha$-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers); polymethyl methacrylates; polybutyl methacrylates; polyvinyl chlorides; polyvinyl acetates; polyethylenes; polypropylenes; polyesters; epoxy resins; epoxy polyol resins; polyurethanes; polyamides; polyvinyl butyrals; polyacrylic acid resins; rosin; modified rosin; terpene resins; aliphatic or alicyclic hydrocarbon resins; aromatic petroleum resins; chlorinated paraffins; and paraffin waxes. These may be used alone or in combination.

The masterbatch can be prepared by mixing/kneading a colorant with a resin for use in a masterbatch through application of high shearing force.

Also, an organic solvent may be used for improving interactions between the colorant and the resin. Further, a so-called flushing method, in which an aqueous paste containing water and a colorant is mixed/kneaded with a resin and an organic solvent and then the colorant is transferred to the resin to remove water and the organic solvent, is preferably used, because a wet cake of the colorant can be directly used (i.e., no drying is required to be performed).

In the mixing/kneading, a high-shearing disperser (e.g., three-roll mill) is preferably used.

<<Releasing Agent>>

The releasing agent is not particularly limited and may be appropriately selected depending on the intended purpose. Examples of the releasing agent include polyolefin waxes (e.g., polyethylene wax and polypropylene wax); long-chain hydrocarbons (e.g., paraffin waxes and SASOL wax); and carbonyl group-containing waxes.

Examples of the carbonyl group-containing wax include polyalkanoic acid esters (e.g., carnauba wax, montan wax, trimethylolpropane tribehenate, pentaerythritol tetrabehenate, pentaerythritol diacetatedibehenate, glycerine tribehenate and 1,18-octadecanediol distearate); polyalkanol esters (e.g., tristearyl trimellitate and distearyl maleate); polyalkanoic acid amides (e.g., ethylenediamine dibehenylamide); polyalkylamides (e.g., tristearylamide trimellitate); and dialkyl ketones (e.g., distearyl ketone).

Among these carbonyl group-containing waxes, polyalkanoic acid esters are preferred.

<<External Additives>>

Inorganic particles or polymeric particles can be suitably used as an external additive for augmenting fluidity, developability, and chargeability of the colored particles obtained in the present invention.

—Inorganic Particles—

The primary particle size of the inorganic particles is preferably 5 nm to 2 μm, more preferably 5 nm to 500 nm. The specific surface area of the inorganic particles is preferably 20 $m^2/g$ to 500 $m^2/g$ as measured by BET method.

The usage rate of the inorganic particles is preferably 0.01% by mass to 5% by mass, more preferably 0.01% by mass to 2.0% by mass relative to the toner.

Examples of the inorganic particles include silica, alumina, titanium oxide, barium titanate, magnesium titanate, calcium titanate, strontium titanate, zinc oxide, tin oxide, quartz sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride.

Examples of the polymeric particles include polystyrene, methacrylic ester or acrylic ester copolymers obtained by soap-free emulsion polymerization, suspension polymerization or dispersion polymerization; polycondensates of, for example, silicone, benzoguanamine, and nylon; and polymer particles produced from thermosetting resins.

The external additive can be surface treated with fluidizers to make them hydrophobic, which prevents fluidity and chargeability from being adversely affected even under a high humidity.

Examples of the surface treatment agent for the external additives include silane coupling agents, silylation agents, silane coupling agents having a fluoroalkyl group, organic titanate-based coupling agents, aluminum-based coupling agents, silicone oils, and modified silicone oils.

(Method for Producing Toner)

A method for producing the toner of the present invention includes a step of washing a dispersion slurry which is obtained from a dispersion liquid or an emulsion of a toner material-containing oil phase in an aqueous medium; and, if necessary, further includes other steps.

The dispersion liquid or the emulsion contains a cellulosic dispersion stabilizing agent.

The washing is performed after cellulase is added to the dispersion slurry.

In the method for producing the toner of the present invention, an oil phase in which the binder resin has been dissolved may be added to the aqueous medium. The method for producing toner of the present invention is not limited to the following production method.

One preferable method for producing the toner is as follows. At first, a toner material is dissolved or dispersed in an organic solvent. The resultant solution or dispersion is dispersed into an aqueous medium containing a cellulosic dispersion stabilizing agent, followed by granulating. Cellulase is added to the resultant dispersion slurry, and then washed.

More specifically, the method for producing the toner is as follows.

An organic solvent into which the toner material containing the polyester resin, the colorant and the releasing agent is dispersed is preferably a volatile organic solvent having a boiling point lower than 100° C. from the viewpoint of easiness of subsequent desolvation.

The organic solvent is not particularly limited and may be appropriately selected depending on the intended purpose. Examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used alone or in combination.

Among them, particularly preferred are esters such as methyl ester and ethyl ester; aromatic solvents such as toluene and xylene; and halogenated hydrocarbons such as methylene chloride, 1,2-dichloroethane, chloroform and carbon tetrachloride.

The polyester resin, the colorant and the releasing agent may be dissolved or dispersed at the same time. However, in general, they are individually dissolved or dispersed. The organic solvent used for dissolving or dispersing them may be different or the same. However, the same organic solvent is preferably used considering the subsequent removal of the solvent.

The solution or the dispersion liquid of the polyester resin preferably has a resin concentration of 40% by mass to 80% by mass.

When the resin concentration is too high, the polyester resin becomes difficult to dissolve or disperse. Also, the solution or the dispersion liquid increases in viscosity, which makes it difficult to be handled. When the resin concentration is too low, the amount of the toner produced may become small.

When the modified polyester resin having a terminal isocyanate group is mixed with the polyester resin, they may be mixed together in the same solution or dispersion liquid, or separate solutions or dispersion liquids thereof may be prepared. Considering their solubility and viscosity, it is preferable to prepare separate solutions or dispersion liquids of the polyester resin and the modified polyester resin having a terminal isocyanate group.

The colorant may be dissolved or dispersed alone, or may be mixed with the solution or the dispersion liquid of the polyester resin.

If needed, a dispersing aid or a polyester resin may be added, or the masterbatch may be used.

In the case of dissolving or dispersing wax as the releasing agent, a dispersion liquid of the wax should be made unless the wax is dissolved in an organic solvent. The dispersion liquid may be made by common methods.

That is, the organic solvent may mixed with the wax followed by dispersion with a disperser such as a bead mill.

Alternatively, the organic solvent may be mixed with the wax, heated to the melting point of the wax and then cooled while stirring followed by dispersion with a disperser such as a bead mill. In the latter method, a dispersion time may be shortened due to heating.

Some waxes may be mixed, or a dispersing aid or a polyester resin may be added.

Water alone can be used as the aqueous medium, but a water-miscible solvent can also be used. Examples of the water-miscible solvent include alcohols (e.g., methanol, isopropanol and ethylene glycol), dimethylformamide, tetrahydrofuran, cellosolves (e.g., METHYL CELLOSOLVE) (Registered trademark), and lower ketones (e.g., acetone and methyl ethyl ketone).

The amount of the aqueous medium used is preferably 50 parts by mass to 2,000 parts by mass, more preferably 100 parts by mass to 1,000 parts by mass, per 100 parts by mass of the toner material. When the amount is less than 50 parts by mass, the toner material is not dispersed well, so that toner particles having a predetermined particle diameter may not be obtained in some cases. On the other hand, using more than 2,000 parts by mass of the aqueous medium is not economical.

In dispersing in the aqueous medium the solution or dispersion of the toner material, a surfactant or a dispersion stabilizing agent is preferably dispersed in the aqueous medium in advance, since the particle size distribution becomes sharp and the dispersion state becomes stable.

If needed, a surfactant may be used in order for the toner material-containing oil phase to be emulsified and dispersed into the aqueous medium.

The surfactant is not particularly limited and may be appropriately selected depending on the intended purpose. Examples thereof include anionic surfactants such as alkylbenzene sulfonates, α-olefin sulfonates, and phosphoric acid esters; cationic surfactants such as amine salts (e.g., alkyl amine salts, aminoalcohol fatty acid derivatives, polyamine fatty acid derivatives, and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts, and benzethonium chloride); nonionic surfactants such as fatty acid amine derivatives and polyhydric alcohol derivatives; and amphoteric surfactants such as alanine, dodecyl-di(aminoethyl)glycine, di(octylaminoethyl)glycine, and N-alkyl-N,N-dimethylammonium betaine.

When using an anionic surfactant having a fluoroalkyl group, it can exhibit surfactant activity even in a small amount.

Examples of the anionic surfactant having a fluoroalkyl group include fluoroalkyl carboxylic acids having 2 to 10 carbon atoms or metal salts thereof, disodium perfluorooctanesulfonyl glutamate, sodium 3-[ω-fluoroalkyl($C_6$-$C_{11}$)oxy]-1-alkyl($C_3$-$C_4$)sulfonate, sodium 3-[ω-fluoroalkanoyl($C_6$-$C_8$)—N-ethylamino]-1-propanesulfonate, fluoroalkyl($C_{11}$-$C_{20}$)carboxylic acids or metal salts thereof, perfluoroalkyl($C_7$-$C_{13}$)carboxylic acids or metal salts thereof, perfluoroalkyl($C_4$-$C_{12}$)sulfonic acids or metal salts thereof, perfluorooctanesulfonic acid diethanol amide, N-propyl-N-(2-hydroxyethyl)perfluorooctanesulfone amide, perfluoroalkyl($C_6$-$C_{10}$)sulfonamide propyl trimethyl ammonium salts, perfluoroalkyl($C_6$-$C_{10}$)-N-ethylsulfonylglycine salts, and monoperfluoroalkyl($C_6$-$C_{16}$) ethyl phosphates. These may be used alone or in combination.

Examples of the cationic surfactants include aliphatic primary, secondary or tertiary amines having a fluoroalkyl group, aliphatic quaternary ammonium salts such as perfluoroalkyl($C_6$-$C_{10}$)sulfonamide propyl trimethyl ammonium salts, benzalkonium salts, benzethonium chloride, pyridinium salts, and imidazolinium salts.

As described above, the cellulosic dispersion stabilizing agent is used as the dispersion stabilizing agent. However, other dispersion stabilizing agents (protective colloids) may be used in addition to the cellulosic dispersion stabilizing agent.

Examples of the other dispersion stabilizing agents include acids, (meth)acrylic monomers having a hydroxyl group, vinyl alcohols or ethers of vinyl alcohols, esters of vinyl alcohol and a compound having a carboxyl group, amide compounds or methylol compounds thereof, chlorides, homopolymers or copolymers of those having a nitrogen atom or a heterocycle containing a nitrogen atom, and polyoxyethylene compounds.

The acids are not particularly limited and may be appropriately selected depending on the intended purpose. Examples of the acids include acrylic acid, methacrylic acid, α-cyanoacrylic acid, α-cyanomethacrylic acid, itaconic acid, crotonic acid, fumaric acid, maleic acid, and maleic anhydride. Examples of the (meth)acrylic monomers having a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerol monoacrylic acid esters, glycerol monomethacrylic acid esters, N-methylolacrylamide, and N-methylolmethacrylamide. Examples of the vinyl alcohols or ethers of vinyl alcohols include vinyl methyl ether, vinyl ethyl ether, and vinyl propyl ether. Examples of the esters of vinyl alcohol and a compound having a carboxyl group include vinyl acetate, vinyl propionate, and vinyl butyrate. Examples of the amide compounds or methylol compounds thereof include acrylamide, methacrylamide, diacetoneacrylamide acid or methylol compounds thereof. Examples of the chlorides include acrylic acid chloride and methacrylic acid chloride. Examples of the homopolymers or copolymers of those having a nitrogen atom or a heterocycle containing a nitrogen atom include vinyl pyridine, vinyl pyrrolidone, vinyl imidazole, and ethyleneimine. Examples of the polyoxyethylene compounds include polyoxyethylene, polyoxypropylene, polyoxyethylene alkylamines, polyoxypropylene alkylamines, polyoxyethylene alkylamides, polyoxypropylene alkylamides, polyoxyethylene nonylphenyl ethers, polyoxyethylene lauryl phenyl ethers, polyoxyethylene stearyl phenyl esters, and polyoxyethylene nonylphenyl esters. These may be used alone or in combination.

When using the other dispersion stabilizing agents in combination, the amount of the cellulosic dispersion stabilizing agent is preferably 50% by mass or more relative to the total amount of the dispersion stabilizing agent.

In dispersing in the aqueous medium the solution or dispersion of the toner material, organic resin particles may be dispersed in the aqueous medium in advance in order for the particle size distribution to be sharp.

The resin forming the organic resin particles may be any resin so long as it can form aqueous dispersions. It may be a thermoplastic resin or a thermosetting resin. Examples thereof include vinyl resins, polyurethane resins, epoxy resins, polyester resins, polyamide resins, polyimide resins, silicon resins, phenol resins, melamine resins, urea resins, aniline resins, ionomer resins and polycarbonate resins. These may be used alone or in combination.

Among them, vinyl resins, polyurethane resins, epoxy resins, polyester resins and mixtures thereof are preferred from the viewpoint of easily obtaining aqueous dispersions of spherical resin particles.

An inorganic dispersing agent may be used as long as it interferes with the object of the present invention.

Examples of the inorganic dispersing agent include tricalcium phosphate, calcium carbonate, titanium oxide, colloidal silica and hydroxyapatite.

When acid- and alkali-soluble compounds such as calcium phosphate are used as the dispersion stabilizing agent, the calcium phosphate is removed from the particles by, for example, dissolving the calcium phosphate with an acid such as hydrochloric acid and then washing with water.

Alternatively, the calcium phosphate can be removed by other manipulations such as enzymatic degradation.

When the dispersing agent is used, the dispersing agent can remain on the surfaces of the toner particles, but it is preferably washed off from the viewpoint of charging of the toner.

An average particle diameter of the organic resin particles can be measured in the form of a dispersion using measurement devices such as LA-920 (product of HORIBA, Ltd.) or UPA-EX150 (product of NIKKISO CO., LTD.)

A method for producing the aqueous dispersion liquid of the organic resin particles is not particularly limited and may be appropriately selected depending on the intended purpose. Examples thereof include the following (a) to (h):

(a) In the case of a vinyl resin, a method for directly producing the aqueous dispersion liquid of the resin particles by a polymerization reaction such as a suspension polymerization, an emulsification polymerization, a seed polymerization, or a dispersion polymerization, using a monomer as a starting material.

(b) In the case of a polyaddition or condensation resin such as a polyester resin, polyurethane resin, and epoxy resin, a method for producing the aqueous dispersion liquid of the resin particles by dispersing a precursor (e.g. monomer or oligomer) or a solvent solution thereof in an aqueous medium in the presence of an appropriate dispersing agent, and then curing by heating or adding a curing agent.

(c) In the case of a polyaddition or condensation resin such as a polyester resin, polyurethane resin, and epoxy resin, a method in which after dissolving an appropriate emulsifying agent in a precursor (e.g., monomer or oligomer) or a solvent solution thereof (preferably in form of a liquid, which may be liquefied by heating), water is added thereto to perform phase transfer emulsification.

(d) A method in which a resin that has been prepared by a polymerization reaction (which may be any polymerization reaction such as an addition polymerization, a ring-opening polymerization, a polyaddition, an addition condensation, and a condensation polymerization) is pulverized by means of a pulverizer such as a mechanical rotation type or a jet type pulverizer, followed by classification to obtain resin particles, and the resultant resin particles are dispersed in water in the presence of an appropriate dispersing agent.

(e) A method in which a resin that has been prepared by a polymerization reaction (which may be any polymerization reaction such as an addition polymerization, a ring-opening polymerization, a polyaddition, an addition condensation, and a condensation polymerization) is dissolved in a solvent to prepare a resin solution, the resultant resin solution is sprayed in the form of mist to obtain resin particles, and the resultant resin particles are dispersed in water in the presence of an appropriate dispersing agent.

(f) A method in which a resin that has been prepared by a polymerization reaction (which may be any polymerization reaction such as an addition polymerization, a ring-opening polymerization, a polyaddition, an addition condensation, and a condensation polymerization) is dissolved in a solvent to prepare a resin solution, resin particles are precipitated by adding a solvent to the resin solution or cooling the resin solution which has been dissolved into a solvent by heating, followed by removing the solvent to obtain resin particles, and the resultant resin particles are dispersed in water in the presence of an appropriate dispersing agent.

(g) A method in which a resin that has been prepared by a polymerization reaction (which may be any polymerization reaction such as an addition polymerization, a ring-opening polymerization, a polyaddition, an addition condensation, and a condensation polymerization) is dissolved in a solvent to prepare a resin solution, the resultant resin solution is dispersed in an aqueous medium in the presence of an appropriate dispersing agent, and the solvent is removed therefrom by heating or reducing the pressure.

(h) A method in which a resin that has been prepared by a polymerization reaction (which may be any polymerization reaction such as an addition polymerization, a ring-opening polymerization, a polyaddition, an addition condensation, and a condensation polymerization) is dissolved in a solvent to prepare a resin solution, an appropriate emulsifying agent is dissolved in the resultant resin solution, and water is added thereto to perform phase transfer emulsification.

A method for dispersing or emulsifying the toner material is not particularly limited and may be appropriately selected depending on the intended purpose. The method may use, for example, a low-speed shearing disperser, a high-speed shearing disperser, a friction disperser, a high-pressure jet disperser or an ultrasonic disperser. Among them, a high-speed shearing disperser is preferably used to form dispersions having a particle diameter of 2 μm to 20 μm.

When using the high-speed shearing disperser, the rotation speed thereof is not particularly limited, but is preferably 1,000 rpm to 30,000 rpm, more preferably 5,000 rpm to 20,000 rpm.

The dispersion temperature is preferably 0° C. to 150° C. (under pressure), more preferably 20° C. to 80° C.

The organic solvent can be removed from the obtained emulsified dispersion of toner particles by a known method.

One employable method is a method in which the temperature of the reaction system is gradually increased under normal or reduced pressure to thereby completely evaporate off and remove the organic solvent contained in the liquid droplets.

When the modified polyester resin having a terminal isocyanate group and the amines reactive therewith in order to introduce the modified polyester resin having a urethane and/or urea group, the amines may be added to the oil phase before the toner material is dispersed in the aqueous medium, or the amines may be added to the aqueous medium.

The time required for the above reaction is appropriately selected depending on the reactivity between the amines added and the isocyanate group-containing structure the polyester prepolymer has, but is preferably 1 min to 40 hours, more preferably 1 hour to 24 hours.

The temperature for the reaction is preferably 0° C. to 150° C., more preferably 20° C. to 98° C.

Post-desolvated dispersion slurry are washed and dried as follows. At first, the cellulosic dispersion stabilizing is decomposed by adding cellulase into the dispersion slurry. Alternatively the dispersion slurry is filtered and redispersed into water. Then, the cellulosic dispersion stabilizing agent is decomposed by adding cellulase thereto, followed by separating into solid and liquid by a centrifuge or a filter press. The thus obtained toner cake is redispersed in ion-exchanged water followed by separating into solid and liquid. The above process of separation and redispersion is repeated several times to remove impurities and surfactant. Thereafter, the obtained product is dried with, for example, an air-flow dryer, an air-circulation dryer, a reduced-pressure dryer or a vibration-flow dryer.

Here, fine toner particles may be removed with, for example, a centrifuge. Also, after drying, the obtained toner particles may optionally be classified using a known classifying apparatus so as to have a desired particle size distribution.

A desired effect can be attained by directly adding the cellulase-containing mixture to the dispersion slurry prior to the washing step.

The cellulosic dispersion stabilizing agent is preferably decomposed while controlling temperature to a range of 30° C. to 60° C. and pH to a range of 4 to 7, more preferably pH to a range of 5 to 6.

Controlling temperature to a range of 30° C. to 60° C. and pH to a range of 4 to 7 enhances enzyme activity to thereby decompose and remove the cellulosic dispersion stabilizing agent sufficiently and prevents uneven washing performance. Therefore, a charge leaking substance on the surfaces of the toner particles is efficiently washed, leading to satisfactory charging performance. When the temperature is lower than 30° C., the enzyme activity may be reduced. When the temperature is higher than 60° C., the enzyme may be inactivated by thermal denaturation. Notably, the pH can be adjusted with acids or alkalis.

The amount of the cellulase added depends on the type of the cellulosic dispersion stabilizing agent, the amount of the cellulosic dispersion stabilizing agent added, and the type of the cellulase-containing mixture, but is preferably 30 ppm to 400 ppm, more preferably 40 ppm to 60 ppm relative to that of the toner particle dispersion liquid.

When the amount is less than 30 ppm, the cellulosic dispersion stabilizing agent may be decomposed insufficiently. When the amount is more than 400 ppm, the toner particle dispersion liquid is increased in viscosity, therefore, the washing may tend to be insufficient.

The viscosity of the toner particle dispersion liquid to which the cellulase has been added is preferably 2.0 mPa·s to 9.5 mPa·s, more preferably 2.0 mPa·s to 6.5 mPa·s, further preferably 2.0 mPa·s to 5.0 mPa·s at 23° C.

When the viscosity of the toner particle dispersion liquid to which the cellulase has been added is more than 9.5 mPa·s, the toner particle dispersion liquid is increased in viscosity, therefore, the washing may tend to be insufficient. Additionally, the dispersion stabilizing agent may remain, potentially leading to uneven toner chargeability. When the viscosity of the toner particle dispersion liquid to which the cellulase has been added is less than 2.0 mPa·s, the cellulosic dispersion stabilizing agent in the toner particle dispersion liquid is rapidly decomposed and tends to form micelles on the surfaces of the toner particles, which may extremely deteriorate filterability in the washing step.

The viscosity of the toner particle dispersion liquid can be measured with DIGITAL VISMETRON VISCOMETER VDA2 (product of Shibaura System Co., Ltd.) A measurement method is as follows.

At first, pure water is added to a sample to thereby adjust the solid content thereof to 32%±1%. The temperature of the sample is adjusted to 23° C.±1° C. When the temperature is adjusted using a hot-water bath, a vessel containing the sample is sealed. The viscosity is measured by adding 20 mL of the toner particle dispersion liquid into a specialized cup cylinder placed under a rotor and measuring at 20 rpm for 60 sec.

The ion exchanged water used for washing the toner cake which has been decomposed with the cellulosic dispersion stabilizing agent has preferably pH of 6 to 8.

The ion exchanged water having pH of 6 to 8 can efficiently wash and remove a charge leaking substance and a performance impairing substance on the surfaces of the toner particles.

The toner cake immediately after being separated into solid and liquid contains relatively many charge leaking substances and performance impairing substances. Therefore, in the case of washing with washing water having pH of less than 6 or more than 8, the charge leaking substances and the performance impairing substances tends to remain on the surfaces of the toner particles, which deteriorates washing and removing effect and adversely affects filterability in the washing step.

The temperature of the washing water (ion exchanged water) is preferably 20° C. to 25° C. in terms of process control.

The dried toner powder thus obtained is mixed with other particles such as charge control particles or fluidizer particles, and mechanical impact may be applied to the mixed powder to thereby fix and fuse them at the surfaces, and prevent the other particles from being exfoliated from the surface of the resultant composite particles.

Specifically, a mixture may be subjected to impact force by blades rotating at high speed. Alternatively, a mixture may be put into a high-speed gas flow and accelerated, so that the particles collide with each other, or composite particles collide with a collision plate.

Examples of the apparatus used for this include ONG MILL (product of Hosokawa Micron Corporation), modified I MILL (product of Nippon Pneumatic Mfg. Co., Ltd.) in which the pressure of pulverization air is reduced, HYBRIDIZATION SYSTEM (product of Nara Machinery Co., Ltd.), KRYPTRON SYSTEM (product of Kawasaki Heavy Industries, Ltd.), and automatic mortars.

The shape of the toner particles is preferably almost shaped like a sphere, which is advantageous in terms of improvement of image quality such as image reproducibility because the toner particles is increased in flowability to thereby prevent problems such as raggedness of images from easily occurring.

The average sphericity thereof is preferably 0.94 or more, more preferably 0.96 to 0.97. When the average sphericity is more than 0.97, cleanability may be deteriorated.

The particle size distribution of the toner particles is preferably sharp from the viewpoint of even chargeability. The particle size distribution is preferably 1.05 to 1.15 as expressed in a ratio of the weight average particle diameter (Dv) to the number average particle diameter (Dn) (Dv/Dn).

In the present invention, the toner particles having a sharp particle size distribution can be obtained by using the aqueous medium containing the dispersion stabilizing agent.

<Developer>

The toner of the present invention can be used either as a one-component developer or a two-component developer by combining with a carrier.

EXAMPLES

The present invention will next be described by way of Examples. The present invention should not be construed as being limited to the Examples.

At first, the measurement method used in the present invention will be explained.

<Measurement of Molecular Weight>

The molecular weight of the resin was measured through GPC (gel permeation chromatography) under the following conditions.

Apparatus: HLC-8220GPC (product of Tosoh Corporation)
Column: TSK gel Super HZM-M×3
Temperature: 40° C.
Solvent: THF (tetrahydrofuran)
Flow rate: 0.35 mL/min
Sample concentration: 0.05% by mass to 0.6% by mass Firstly, 0.01 mL of the sample having the concentration described above was injected. Based on the molecular weight distribution of the toner resin measured under the above conditions, the weight average molecular weight (Mw) of the resin were calculated using a molecular weight calibration curve obtained from monodispersed polystyrene standard samples.

The monodispersed dispersion polystyrene standard samples were the following ten samples: 5.8×100, 1.085×10,000, 5.95×10,000, 3.2×100,000, 2.56×1,000,000, 2.93×1,000, 2.85×10,000, 1.48×100,000, 8.417×100,000 and 7.5×1,000,000.

<Measurement of Glass Transition Temperature>

The glass transition temperature of the resin can be measured by using, for example, a differential scanning calorimeter (DSC-6220R, product of Seiko Instruments Inc.) in the following manner: Heat the sample from room temperature to 150° C. at a temperature rising rate of 10° C./min; Leave the sample at 150° C. for 10 min; Cool down the sample to room temperature; Leave the sample at room temperature for 10 min; Heat the sample again to 150° C. at a temperature rising rate of 10° C./min; and Determine the glass transition temperature from the base line at a temperature equal to or lower than the glass transition temperature and a curved line portion in which the height of the base line is equal to half thereof at a temperature equal to or higher than the glass transition temperature.

<Measurement of Average Sphericity>

An optical detection method can be suitably used for measuring the average sphericity of the toner in which particle images are optically detected and analyzed by a CCD camera while a suspension liquid containing the toner passes through an imaging detective portion in the form of a plate.

The average circularity of the particles is obtained by dividing the circumferential length of the circle having the area equal to thus obtained projected toner area by the circumferential length of the actual particles.

The average circularity was measured using a flow-type particle image analyzer FPIA-2000 (product of SYSMEX CORPORATION).

Specifically, 0.1 mL to 0.5 mL of a surfactant (alkylbenzene sulfonate) was added as a dispersing agent into 100 mL to 150 mL of water in a vessel, from which solid impurities had previously been removed. Then, about 0.1 mg to about 0.5 g of a measurement sample was added to the vessel, followed by dispersing.

The resultant suspension was subjected to dispersing treatment by an ultrasonic disperser for about 1 min to about 3 min, and the concentration of the dispersion liquid was adjusted such that the number of particles in the sample is 3,000 per microliter to 10,000 per microliter. In this state, the shape and distribution of the toner were measured using the analyzer.

<Measurement of Volume Average Particle Diameter>

The volume average particle diameter of the toner was measured using the COULTER COUNTER method. Examples of measurement apparatus employable in the measurement of the particle size distribution of toner particles by the COULTER COUNTER method include COULTER COUNTER TA-II and COULTER MULTISIZER II (these products are of Beckman Coulter, Inc.).

The measurement method will next be described.

First, 0.1 mL to 5 mL of a surfactant (alkylbenzene sulfonate) was added as the dispersing agent to 100 mL to 150 mL of an aqueous electrolyte solution.

Here, the aqueous electrolyte solution was an about 1% by mass aqueous NaCl solution prepared using 1st grade sodium chloride, and, for example, ISOTON-II (product of Beckman Coulter, Inc.) can be used.

Subsequently, 2 mg to 20 mg of a measurement sample based on the solid matter was added and suspended in the aqueous electrolyte solution.

The resultant suspension liquid was subjected to dispersing treatment by for about 1 min to about 3 min, and was analyzed with the above-described apparatus using an aperture of 100 μm to thereby measure the number and the volume of the toner particles. Based on thus obtained values, the volume distribution and the number distribution were calculated.

Based on these distributions, the volume average particle diameter (Dv) and the number average particle diameter (Dn) of the toner were obtained.

Notably, in this measurement, the following 13 channels were used: 2.00 μm or more but less than 2.52 μm; 2.52 μm or more but less than 3.17 μm; 3.17 μm or more but less than 4.00 μm; 4.00 μm or more but less than 5.04 μm; 5.04 μm or more but less than 6.35 μm; 6.35 μm or more but less than 8.00 μm; 8.00 μm or more but less than 10.08 μm; 10.08 μm or more but less than 12.70 μm; 12.70 μm or more but less than 16.00 μm; 16.00 μm or more but less than 20.20 μm; 20.20 μm or more but less than 25.40 μm; 25.40 μm or more but less than 32.00 μm; and 32.00 μm or more but less than 40.30 μm; i.e., particles having a particle diameter of 2.00 μm or more but less than 40.30 μm were subjected to the measurement.

Example 1

<Synthesis of Polyester>

A reaction vessel equipped with a condenser, a stirrer and a nitrogen-introducing pipe was charged with bisphenol A ethylene oxide 2 mol adduct (553 parts by mass), bisphenol A propylene oxide 2 mol adduct (197 parts by mass), terephthalic acid (220 parts by mass), adipic acid (45 parts by mass) and dibutyl tinoxide (2 parts by mass), followed by allowing to react at 230° C. for 7 hours under normal pressure. Next, the reaction mixture was allowed to react for 5 hours under a reduced pressure of 10 mmHg to 15 mmHg. Then, trimellitic anhydride (25 parts by mass) was added to the reaction vessel, followed by allowing to react at 180° C. for 2 hours under normal pressure to thereby obtain [polyester 1].

The thus-obtained [polyester 1] was found to have the number average molecular weight of 2,200, the weight average molecular weight of 5,600, the glass transition temperature (Tg) of 44° C. and the acid value of 25 mgKOH/g.

<Synthesis of Prepolymer>

A reaction vessel equipped with a condenser, a stirrer and a nitrogen-introducing pipe was charged with 1,2-puropylene glycol (365 parts by mass), terephthalic acid (565 parts by mass), trimellitic anhydride (43 parts by mass) and titanium tetrabutoxide (4 parts by mass), followed by allowing to react at 230° C. for 9 hours under normal pressure. Additionally, the reaction mixture was allowed to react for 5 hours under a reduced pressure of 10 mmHg to 15 mmHg to thereby obtain [intermediate polyester 1].

The thus-obtained [intermediate polyester 1] was found to have the number average molecular weight of 3,200, the weight average molecular weight of 12,000, and the glass transition temperature of 57° C.

Next, a reaction vessel equipped with a condenser, a stirrer and a nitrogen-introducing pipe was charged with the [intermediate polyester 1] (421 parts by mass), isophorone diisocyanate (82 parts by mass) and ethyl acetate (500 parts by mass), followed by allowing to react at 100° C. for 5 hours, to thereby obtain [prepolymer 1].

The thus-obtained [prepolymer 1] was found to have the free isocyanate content of 1.42% by mass.

<Synthesis of Masterbatch>

Carbon black (REGAL 400R, product of Cabot Corporation) (41 parts by mass), a polyester resin as the binder resin (60 parts by mass) (RS-801, product of Sanyo Chemical Industries, Ltd., acid value: 10 mgKOH/g, weight average molecular weight (Mw): 20,000, glass transition temperature (Tg): 64° C.) and water (30 parts by mass) were mixed together using HENSCHEL MIXER, to thereby obtain a mixture containing pigment aggregates impregnated with water.

The resultant mixture was kneaded for 60 min with a two-roll mill of which roll surface temperature had been adjusted to 130° C. The kneaded product was pulverized with a pulverizer so as to have a diameter of 1 mm, to thereby obtain [masterbatch 1].

<Preparation of Oil Phase>

A vessel equipped with a stirring rod and a thermometer was charged with the [polyester 1] (96 parts by mass), paraffin wax (melting point: 72° C.) (33 parts by mass) and ethyl acetate (383 parts by mass). The mixture was increased in temperature to 80° C. under stirring, maintained at 80° C. for 7 hours, and cooled to 30° C. for 1 hour.

The obtained mixture was transferred to another vessel, where the mixture was dispersed with a bead mill ("ULTRA VISCOMILL," product of AIMEX CO., Ltd.) under the following conditions: a liquid feed rate of 1 kg/hr, disc circumferential velocity of 7 m/s, 0.5 mm-zirconia beads packed to 80% by volume, and 3 passes, to thereby obtain [raw material solution 1].

Next, a 70% by mass solution of the [polyester 1] in ethyl acetate (338 parts by mass) and the [masterbatch 1] (140 parts by mass) were added to the [raw material solution 1] (328 parts by mass), followed by stirring with a three-one motor for 2 hours to thereby obtain [oil phase 1].

Furthermore, ethyl acetate was added to the [oil phase 1] so that the solid content concentration thereof was adjusted to 50% by mass as measured at 130° C. for 30 min.

<Preparation of Aqueous Phase>

Ion-exchanged water (837.5 parts by mass), a 50% by mass aqueous solution of sodium dodecyldiphenyl ether disulfonate (ELEMINOL MON-7, product of Sanyo Chemical Industries Ltd.) (154 parts by mass), a 1% by mass aqueous solution of carboxymethyl cellulose as the dispersion stabilizing agent (192.5 parts by mass) and ethyl acetate (104 parts by mass) were mixed together and stirred to thereby obtain an opaque white liquid, which was used as [aqueous phase 1].

<Emulsification Step>

The [prepolymer 1] (115 parts by mass) and isophorone diamine (1.8 parts by mass) were added to the total amount of the [oil phase 1], mixed together using TK HOMOMIXER (product of PRIMIX Corporation) at 5,000 rpm for 1 min. Thereafter, the [aqueous phase 1] (832 parts by mass) was added thereto and mixed together using TK HOMOMIXER at 8,000 rpm to 13,000 rpm for 5 min to thereby obtain [emulsion slurry 1].

<Desolvation>

A vessel equipped with a stirrer and a thermometer was charged with the [emulsion slurry 1] and then desolvated at 30° C. for 8 hours to thereby obtain [dispersion slurry 1].

<Heat Treatment>

The [dispersion slurry 1] was charged to a vessel equipped with a stirrer and a thermometer, followed by heating to 80° C. which is 8° C. higher than the melting point of the releasing agent while stirring thoroughly, keeping at 80° C. for 1 hour, and then cooling to room temperature.

<Washing and Drying>

To the [dispersion slurry 1], was added 50 ppm of CELLULIZER ACE (mixture of cellulase and glycerin, product of Nagase ChemteX Co., Ltd.) The resultant was stirred for 10 min with a three-one motor (at normal temperature (25° C.), pH 7.0) to thereby obtain [toner particle dispersion liquid 1].

The thus-obtained [toner particle dispersion liquid 1] (1,000 parts by mass) was filtrated under reduced pressure, and then subjected to the following treatments.

(1) Ion-exchanged water (normal temperature (20° C. to 25° C.)) (1,000 parts by mass) was added to the filtration cake, followed by mixing using TK HOMOMIXER (at 12,000 rpm for 10 min) and filtrating.

(2) Ion-exchanged water (normal temperature (20° C. to 25° C.)) (1,000 parts by mass) was added to the filtration cake obtained in (1). The mixture was mixed using TK HOMOMIXER (at 12,000 rpm for 30 min) under an ultrasonic vibration, followed by filtrating under reduced pressure. This treatment was repeated until the reslurried liquid had the electrical conductivity of 10 μS/cm or lower.

(3) 10% by mass hydrochloric acid was added to the reslurried liquid obtained in (2) so as to have a pH of 4, followed by stirring for 30 min with a three-one motor and filtrating.

(4) Ion-exchanged water (normal temperature (20° C. to 25° C.)) (1,000 parts by mass) was added to the filtration cake obtained in (3), followed by mixing using TK HOMOMIXER (at 12,000 rpm for 10 min) and filtrating. This treatment was repeated until the reslurried liquid had the electrical conductivity of 10 μC/cm or lower, to thereby obtain [filtration cake 1].

The thus obtained [filtration cake 1] was dried with an air-circulation dryer at 45° C. for 48 hours, and then sieved with a mesh having an opening size of 75 μm to thereby obtain [toner base particle1].

The thus obtained [toner base particle 1] was found to have the volume average particle diameter (Dv) of 5.3 μm, the number average particle diameter (Dn) of 4.8 μm, the Dv/Dn of 1.10, and the average sphericity of 0.975.

<External Addition Treatment>

The toner base particles (100 parts by mass) was mixed using HENSCHEL MIXER with hydrophobic silica having a primary particle diameter of 30 nm (0.5 part by mass) and hydrophobic silica having a primary particle diameter of 10 nm (0.5 part by mass) to thereby obtain [developer 1].

Example 2

[Toner base particle 2] and [developer 2] were obtained in the same manner as in Example 1, except that 80 ppm of CELLULIZER ACE (mixture of cellulase, sorbitol, sodium chloride and sodium benzoate, product of Nagase ChemteX Co., Ltd.) was added instead of 50 ppm of CELLULIZER CL.

The thus obtained [toner base particle 2] was found to have the volume average particle diameter (Dv) of 5.3 the number average particle diameter (Dn) of 4.9 μm, the Dv/Dn of 1.10, and the average circularity of 0.970.

Example 3

[Toner base particle 3] and [developer 3] were obtained in the same manner as in Example 1, except that the amount of CELLULIZER CL added at the washing step in Example 1 was changed to 30 ppm.

The thus obtained [toner base particle 3] was found to have the volume average particle diameter (Dv) of 5.7 μm, the number average particle diameter (Dn) of 5.2 μm, the Dv/Dn of 1.12, and the average circularity of 0.972.

Example 4

[Toner base particle 4] and [developer 4] were obtained in the same manner as in Example 1, except that the amount of CELLULIZER CL added at the washing step in Example 1 was changed to 10 ppm.

The thus obtained [toner base particle 4] was found to have the volume average particle diameter (Dv) of 5.3 μm, the number average particle diameter (Dn) of 4.8 μm, the Dv/Dn of 1.10, and the average circularity of 0.970.

Example 5

[Toner base particle 5] and [developer 5] were obtained in the same manner as in Example 1, except that the amount of CELLULIZER CL added at the washing step in Example 1 was changed to 100 ppm.

The thus obtained [toner base particle 5] was found to have the volume average particle diameter (Dv) of 5.5 μm, the number average particle diameter (Dn) of 5.0 μm, the Dv/Dn of 1.12, and the average circularity of 0.966.

Example 6

[Toner base particle 6] and [developer 6] were obtained in the same manner as in Example 1, except that the temperature of ion-exchanged water at the washing step in Example 1 was changed from normal temperature (20° C. to 25° C.) to 30° C. to 35° C.

The thus obtained [toner base particle 6] was found to have the volume average particle diameter (Dv) of 5.4 μm, the number average particle diameter (Dn) of 4.9 μm, the Dv/Dn of 1.11, and the average circularity of 0.968.

Example 7

[Toner base particle 7] and [developer 7] were obtained in the same manner as in Example 2, except that the temperature of ion-exchanged water at the washing step in Example 2 was changed from normal temperature (20° C. to 25° C.) to 30° C. to 35° C.

The thus obtained [toner base particle 7] was found to have the volume average particle diameter (Dv) of 5.4 μm, the number average particle diameter (Dn) of 4.8 μm, the Dv/Dn of 1.12, and the average circularity of 0.967.

Example 8

[Toner base particle 8] and [developer 8] were obtained in the same manner as in Example 3, except that the temperature of ion-exchanged water at the washing step in Example 3 was changed from normal temperature (20° C. to 25° C.) to 30° C. to 35° C.

The thus obtained [toner base particle 8] was found to have the volume average particle diameter (Dv) of 5.6 nm, the number average particle diameter (Dn) of 5.2 μm, the Dv/Dn of 1.13, and the average circularity of 0.965.

Example 9

[Toner base particle 9] and [developer 9] were obtained in the same manner as in Example 4, except that the temperature of ion-exchanged water at the washing step in Example 4 was changed from normal temperature (20° C. to 25° C.) to 30° C. to 35° C.

The thus obtained [toner base particle 9] was found to have the volume average particle diameter (Dv) of 5.4 nm, the number average particle diameter (Dn) of 4.9 nm, the Dv/Dn of 1.12, and the average circularity of 0.969.

Example 10

[Toner base particle 10] and [developer 10] were obtained in the same manner as in Example 5, except that the temperature of ion-exchanged water at the washing step in Example 5 was changed from normal temperature (20° C. to 25° C.) to 30° C. to 35° C.

The thus obtained [toner base particle 10] was found to have the volume average particle diameter (Dv) of 5.5 μm, the number average particle diameter (Dn) of 4.8 nm, the Dv/Dn of 1.13, and the average circularity of 0.970.

Example 11

[Toner base particle 11] and [developer 11] were obtained in the same manner as in Example 1, except that the temperature of ion-exchanged water at the washing step in Example 1 was changed from normal temperature (20° C. to 25° C.) to 10° C. to 15° C.

The thus obtained [toner base particle 11] was found to have the volume average particle diameter (Dv) of 5.2 μM, the number average particle diameter (Dn) of 4.9 vim, the Dv/Dn of 1.12, and the average circularity of 0.964.

Example 12

[Toner base particle 12] and [developer 12] were obtained in the same manner as in Example 2, except that the temperature of ion-exchanged water at the washing step in Example 2 was changed from normal temperature (20° C. to 25° C.) to 10° C. to 15° C.

The thus obtained [toner base particle 12] was found to have the volume average particle diameter (Dv) of 5.5 the number average particle diameter (Dn) of 4.9 vim, the Dv/Dn of 1.12, and the average circularity of 0.969.

Example 13

[Toner base particle 13] and [developer 13] were obtained in the same manner as in Example 3, except that the temperature of ion-exchanged water at the washing step in Example 3 was changed from normal temperature (20° C. to 25° C.) to 10° C. to 15° C.

The thus obtained [toner base particle 13] was found to have the volume average particle diameter (Dv) of 5.5 μm, the number average particle diameter (Dn) of 5.1 μm, the Dv/Dn of 1.13, and the average circularity of 0.968.

Example 14

[Toner base particle 14] and [developer 14] were obtained in the same manner as in Example 4, except that the temperature of ion-exchanged water at the washing step in Example 4 was changed from normal temperature (20° C. to 25° C.) to 10° C. to 15° C.

The thus obtained [toner base particle 14] was found to have the volume average particle diameter (Dv) of 5.4 μm, the number average particle diameter (Dn) of 4.9 μm, the Dv/Dn of 1.12, and the average circularity of 0.963.

Example 15

[Toner base particle 15] and [developer 15] were obtained in the same manner as in Example 5, except that the temperature of ion-exchanged water at the washing step in Example 5 was changed from normal temperature (20° C. to 25° C.) to 10° C. to 15° C.

The thus obtained [toner base particle 15] was found to have the volume average particle diameter (Dv) of 5.6 μm, the number average particle diameter (Dn) of 4.9 μm, the Dv/Dn of 1.13, and the average circularity of 0.964.

Comparative Example 1

[Toner base particle 16] and [developer 16] were obtained in the same manner as in Example 1, except that the cellulase was not added at the washing step in Example 1.

The thus obtained [toner base particle 16] was found to have the volume average particle diameter (Dv) of 5.5 μm, the number average particle diameter (Dn) of 4.9 μm, the Dv/Dn of 1.13, and the average circularity of 0.968.

Comparative Example 2

[Toner base particle 17] and [developer 17] were obtained in the same manner as in Example 6, except that the cellulase was not added at the washing step in Example 6.

The thus obtained [toner base particle 17] was found to have the volume average particle diameter (Dv) of 5.3 μm, the number average particle diameter (Dn) of 4.9 μm, the Dv/Dn of 1.14, and the average circularity of 0.971.

Comparative Example 3

[Toner base particle 18] and [developer 18] were obtained in the same manner as in Example 11, except that the cellulase was not added at the washing step in Example 11.

The thus obtained [toner base particle 18] was found to have the volume average particle diameter (Dv) of 5.6 μm, the number average particle diameter (Dn) of 4.9 μm, the Dv/Dn of 1.15, and the average circularity of 0.964.

The thus obtained toner particle dispersion liquids, washing water and developers were evaluated as follows. Results are shown in Tables 1 and 2.

<pH of Toner Particle Dispersion Liquid and pH of Washing Water>

The pH was measured with MULTI WATER TESTER MM-60R (product of DKK-TOA CORPORATION).

<Viscosity Measurement of Toner Particle Dispersion Liquid>

The viscosity of the toner particle dispersion liquid was measured using DIGITAL VISMETRON VISCOMETER VDA2 (B-type viscometer; product of Shibaura System Co., Ltd.) as follows.

At first, pure water was added to a sample to thereby adjust the solid content thereof to 32% by mass±1% by mass. The temperature of the sample was adjusted to 23° C.±1° C. When the temperature was adjusted using a hot-water bath, a vessel containing the sample was sealed. The viscosity was measured by adding 20 mL of the toner particle dispersion liquid into a specialized cup cylinder placed under a rotor and measuring at 20 rpm for 60 sec.

<Filterability Evaluation of Toner Particle Dispersion Liquid>

A filter paper (110 mm, product of Advantec Toyo Kaisha, Ltd.) was placed into a Buchner funnel and 50 mL of the toner particle dispersion liquid before the washing step was added thereto. After filtering under reduced pressure for 30 min, water content (% by mass) of the filter cake remaining on the filter paper was determined and evaluated according to the following criteria, which was used as an index of filterability.

[Evaluation Criteria]

A: The water content of the filter cake was less than 30% by mass.

B: The water content of the filter cake was 30% by mass or more but less than 40% by mass.

C: The water content of the filter cake was 40% by mass or more but less than 50% by mass.

D: The water content of the filter cake was 50% by mass or more.

<Chargeability Evaluation>

A predetermined printed pattern having a B/W ratio of 6% was continuously printed with each toner (developer) which had been subjected to the external addition treatment under N/N environment (23° C. and 45% RH) using the image forming apparatus (IPSIO CX 2500, product of Ricoh Co. Ltd.)

After printing 50 sheets of paper under the N/N environment, 0.2 g of the developer on the development roller during printing a blank pattern was suctioned. The developer was charged into a Faraday cage cell and measured for the amount of charge using the blowoff powder charge amount measurement device (TB-203, product of Toshiba Chemical Corp.) while adjusting the blow pressure to 10.0 kPa±0.1 kPa and the suction pressure to −5.0 kPa±0.5 kPa. The chargeability was evaluated according to the following criteria.

[Evaluation Criteria]

A: The amount of charge is 30 μC/g or more.

B: The amount of charge is 25 μC/g or more but less than 30 μC/g.

C: The amount of charge is 20 μC/g or more but less than 25 μC/g.

D: The amount of charge is less than 20 μC/g or more.

<Evaluation of Stress-Resistant Charge Stability>

A predetermined printed pattern having a B/W ratio of 6% was continuously printed with each toner (developer) which had been subjected to the external addition treatment under N/N environment (23° C. and 45% RH) using the image forming apparatus (IPSIO CX 2500, product of Ricoh Co. Ltd.)

After continuously printing 2,000 sheets of paper under the N/N environment (i.e., after running), 0.2 g of the toner on the development roller during printing a blank pattern was suctioned. The developer was charged into a Faraday cage cell and measured for the difference between the amount of charge after printing 50 sheets of paper and the amount of charge after printing 2,000 sheets of paper using the blowoff powder charge amount measurement device (TB-203, product of Toshiba Chemical Corp.) while adjusting the blow pressure to 10.0 kPa±0.1 kPa and the suction pressure to −5.0 kPa±0.5 kPa. The stress-resistant charge stability was evaluated according to the following criteria.

[Evaluation Criteria]

A: The difference in the amounts of charge was less than 5 μC/g as an absolute value.

B: The difference in the amounts of charge was 5 μC/g or more but less than 10 μC/g as an absolute value.

C: The difference in the amounts of charge was 10 μC/g or more but less than 15 μC/g as an absolute value.

D: The difference in the amounts of charge was 15 μC/g or more as an absolute value.

<Image Smear Evaluation>

A predetermined printed pattern having a B/W ratio of 6% was continuously printed with each toner (developer) which had been subjected to the external addition treatment under N/N environment (23° C. and 45% RH) using the image forming apparatus (IPSIO CX 2500, product of Ricoh Co. Ltd.)

After continuously printing 2,000 sheets of paper under the N/N environment (i.e., after running), a test pattern was printed. The image smear was evaluated according to the following criteria.

Specifically, the presence or absence of a toner streak and a black spot on a blank portion, and the presence or absence of a white streak and a white spot on a solid portion were evaluated.

[Evaluation Criteria]

A: There was no image smear portion.

B: There were 1 or 2 image smear portions.

C: There were 3 to 5 image smear portions.

D: There were 6 or more image smear portions.

<Heat-Resistant Storage Ability>

Ten grams of each toner was weighed and charged into a 30 mL screw vial. The screw vial was sealed and stored at 50° C. for 8 hours in a thermostatic bath, and then the toner was sieved with a 42 mesh metal sieve for 2 min by PANABRATOR EV256 (product of Panasonic Corporation). The residual rate of the toner remaining on the metal sieve was used as an index of the heat-resistant storage ability. The heat-resistant storage ability was ranked into the following 4 grades.

[Evaluation Criteria]

A: lower than 10%

B: 10% or more but less than 20%.

C: 20% or more but less than 30%.

D: 30% or more.

TABLE 1

| | Added amount of cellulase-containing material (ppm) | Viscosity of toner particle dispersion liquid (mPa · s) | Temperature of ion exchanged water (° C.) | Filterability | pH |
|---|---|---|---|---|---|
| Ex. 1 | 50 | 5.64 | Normal (20° C. to 25° C.) | A | 6.8 |
| Ex. 2 | 80 | 4.94 | Normal (20° C. to 25° C.) | A | 7.2 |
| Ex. 3 | 30 | 6.08 | Normal (20° C. to 25° C.) | A | 7.3 |
| Ex. 4 | 10 | 8.76 | Normal (20° C. to 25° C.) | B | 7.3 |
| Ex. 5 | 100 | 4.02 | Normal (20° C. to 25° C.) | B | 7.5 |
| Ex. 6 | 50 | 5.16 | Heated (30° C. to 35° C.) | A | 6.5 |
| Ex. 7 | 80 | 4.44 | Heated (30° C. to 35° C.) | A | 7.0 |
| Ex. 8 | 30 | 5.42 | Heated (30° C. to 35° C.) | A | 7.8 |
| Ex. 9 | 10 | 8.34 | Heated (30° C. to 35° C.) | B | 7.9 |
| Ex. 10 | 100 | 3.98 | Heated (30° C. to 35° C.) | B | 7.2 |
| Ex. 11 | 50 | 5.77 | Cooled (10° C. to 15° C.) | A | 7.3 |
| Ex. 12 | 80 | 4.99 | Cooled (10° C. to 15° C.) | A | 7.4 |
| Ex. 13 | 30 | 6.05 | Cooled (10° C. to 15° C.) | A | 7.6 |
| Ex. 14 | 10 | 8.99 | Cooled (10° C. to 15° C.) | B | 6.9 |
| Ex. 15 | 100 | 4.02 | Cooled (10° C. to 15° C.) | B | 7.2 |
| Comp. Ex. 1 | None | 12.04 | Normal (20° C. to 25° C.) | B | 6.8 |
| Comp. Ex. 2 | None | 10.06 | Heated (30° C. to 35° C.) | B | 7.2 |
| Comp. Ex. 3 | None | 13.12 | Cooled (10° C. to 15° C.) | B | 7.9 |

TABLE 2

| | Chargeability | Stress-resistant charge stability | Image smear | Heat-resistant storage ability |
|---|---|---|---|---|
| Example 1 | A | A | A | A |
| Example 2 | A | A | A | A |
| Example 3 | A | A | A | A |
| Example 4 | B | B | B | A |
| Example 5 | B | B | B | A |
| Example 6 | A | A | A | A |
| Example 7 | A | A | A | A |
| Example 8 | A | A | A | A |
| Example 9 | B | B | B | A |
| Example 10 | B | B | B | A |
| Example 11 | A | A | A | A |
| Example 12 | A | A | A | A |
| Example 13 | A | A | A | A |
| Example 14 | B | B | B | A |
| Example 15 | B | B | B | A |
| Comparative Example 1 | D | D | B | A |
| Comparative Example 2 | B | D | B | A |
| Comparative Example 3 | D | D | B | A |

Example 16

The [dispersion slurry 1] (1,000 parts by mass) obtained in Example 1 was filtrated under reduced pressure. Ion-exchanged water (normal temperature (20° C. to 25° C.)) (1,000 parts by mass) was added thereto, followed by mixing using TK HOMOMIXER (at 12,000 rpm for 10 min). Then, 200 ppm of CELLULIZER CL (mixture of cellulase and glycerin, product of Nagase ChemteX Co., Ltd.) was added thereto to thereby obtain [toner particle dispersion liquid 2]. <Washing and drying> treatment was performed in the following order.

<Washing and Drying>

(1) The [toner particle dispersion liquid 2] was heated to 30° C. and adjusted to have a pH of 6.2 with 10% hydrochloric acid, followed by mixing using TK HOMOMIXER (at 12,000 rpm for 10 min) and filtrating.

(2) Ion-exchanged water (normal temperature (20° C. to 25° C.), pH 7.2) (1,000 parts by mass) was added to the filtration cake obtained in (1). The resultant was mixed using TK HOMOMIXER (at 12,000 rpm for 30 min) under an ultrasonic vibration, followed by filtrating under reduced pressure. This treatment was repeated until the reslurried liquid had the electrical conductivity of 10 μS/cm or lower.

(3) 10% hydrochloric acid was added to the reslurried liquid obtained in (2) so as to have a pH of 4, followed by stirring for 30 min with a three-one motor and filtrating.

(4) Ion-exchanged water (normal temperature (20° C. to 25° C.)) (1,000 parts by mass) was added to the filtration cake obtained in (3), followed by mixing using TK HOMOMIXER (at 12,000 rpm for 10 min) and filtrating. This treatment was repeated until the reslurried liquid had the electrical conductivity of 10 μC/cm or lower, to thereby obtain [filtration cake 16].

The thus obtained [filtration cake 16] was dried with an air-circulation dryer at 45° C. for 48 hours, and then sieved with a mesh having an opening size of 75 μm to obtain [toner base particle 19].

The thus obtained [toner base particle 19] was found to have the volume average particle diameter (Dv) of 5.3 μm, the number average particle diameter (Dn) of 4.7 the Dv/Dn of 1.11, and the average sphericity of 0.976.

The thus obtained [toner base particle 19] (100 parts by mass) was mixed using HENSCHEL MIXER with hydrophobic silica having a primary particle diameter of 30 nm (0.5 part by mass) and hydrophobic silica having a primary particle diameter of 10 nm (0.5 part by mass), to thereby obtain [developer 19].

Example 17

(1) In Example 16, 200 ppm of CELLULIZER CL (mixture of cellulase and glycerin, product of Nagase ChemteX Co., Ltd.) was added, heated to 30° C. and adjusted to have a pH of 3.4 with 10% hydrochloric acid, followed by mixing using TK HOMOMIXER (at 12,000 rpm for 10 min) and filtrating.

(2) Ion-exchanged water (normal temperature (20° C. to 25° C.), pH 7.2) (1,000 parts by mass) was added to the filtration cake obtained in (1). The resultant was mixed using TK HOMOMIXER (at 12,000 rpm for 30 min) under an ultrasonic vibration, followed by filtrating under reduced pressure.

The thus obtained [toner base particle 20] was found to have the volume average particle diameter (Dv) of 5.3 μm, the number average particle diameter (Dn) of 4.9 μm, the Dv/Dn of 1.10, and the average sphericity of 0.970.

[Developer 20] were obtained in the same manner as in Example 16 except the above.

Example 18

(1) In Example 16, 200 ppm of CELLULIZER CL (mixture of cellulase and glycerin, product of Nagase ChemteX Co., Ltd.) was added, heated to 30° C. and adjusted to have a pH of 8.2 with 10% by mass sodium hydroxide, followed by mixing using TK HOMOMIXER (at 12,000 rpm for 10 min) and filtrating.

(2) Ion-exchanged water (normal temperature (20° C. to 25° C.), pH 7.2) (1,000 parts by mass) was added to the filtration cake obtained in (1). The resultant was mixed using TK HOMOMIXER (at 12,000 rpm for 30 min) under an ultrasonic vibration, followed by filtrating under reduced pressure.

The thus obtained [toner base particle 21] was found to have the volume average particle diameter (Dv) of 5.6 μm, the number average particle diameter (Dn) of 5.3 μm, the Dv/Dn of 1.13, and the average sphericity of 0.973.

[Developer 21] were obtained in the same manner as in Example 16 except the above.

Example 19

(1) In Example 16, 200 ppm of CELLULIZER CL (mixture of cellulase and glycerin, product of Nagase ChemteX Co., Ltd.) was added, heated to 30° C. and adjusted to have a pH of 6.2 with 10% hydrochloric acid, followed by mixing using TK HOMOMIXER (at 12,000 rpm for 10 min) and filtrating.

(2) Ion-exchanged water (normal temperature (20° C. to 25° C.), pH 5.2) (1,000 parts by mass) was added to the filtration cake obtained in (1). The resultant was mixed using TK HOMOMIXER (at 12,000 rpm for 30 min) under an ultrasonic vibration, followed by filtrating under reduced pressure.

The thus obtained [toner base particle 22] was found to have the volume average particle diameter (Dv) of 5.2 μm, the number average particle diameter (Dn) of 4.7 μm, the Dv/Dn of 1.09, and the average sphericity of 0.969.

[Developer 22] were obtained in the same manner as in Example 16 except the above.

Example 20

(1) In Example 16, 200 ppm of CELLULIZER CL (mixture of cellulase and glycerin, product of Nagase ChemteX Co., Ltd.) was added, heated to 30° C. and adjusted to have a pH of 6.2 with 10% by mass sodium hydroxide, followed by mixing using TK HOMOMIXER (at 12,000 rpm for 10 min) and filtrating.

(2) Ion-exchanged water (normal temperature (20° C. to 25° C.), pH 9.0) (1,000 parts by mass) was added to the filtration cake obtained in (1). The resultant was mixed using TK HOMOMIXER (at 12,000 rpm for 30 min) under an ultrasonic vibration, followed by filtrating under reduced pressure.

The thus obtained [toner base particle 23] was found to have the volume average particle diameter (Dv) of 5.6 μm, the number average particle diameter (Dn) of 4.9 μm, the Dv/Dn of 1.11, and the average sphericity of 0.965.

[Developer 23] were obtained in the same manner as in Example 16 except the above.

Example 21

(1) In Example 16, 200 ppm of CELLULIZER CL (mixture of cellulase and glycerin, product of Nagase ChemteX Co., Ltd.) was added, heated to 60° C. and adjusted to have a pH of 6.2 with 10% hydrochloric acid, followed by mixing using TK HOMOMIXER (at 12,000 rpm for 10 min) and filtrating.

(2) Ion-exchanged water (normal temperature (20° C. to 25° C.), pH 7.2) (1,000 parts by mass) was added to the filtration cake obtained in (1). The resultant was mixed using TK HOMOMIXER (at 12,000 rpm for 30 min) under an ultrasonic vibration, followed by filtrating under reduced pressure.

The thus obtained [toner base particle 24] was found to have the volume average particle diameter (Dv) of 5.5 μm, the number average particle diameter (Dn) of 5.0 μm, the Dv/Dn of 1.12, and the average sphericity of 0.969.

[Developer 24] were obtained in the same manner as in Example 16 except the above.

Example 22

(1) In Example 16, 200 ppm of CELLULIZER CL (mixture of cellulase and glycerin, product of Nagase ChemteX Co., Ltd.) was added, heated to 60° C. and adjusted to have a pH of 3.4 with 10% hydrochloric acid, followed by mixing using TK HOMOMIXER (at 12,000 rpm for 10 min) and filtrating.

(2) Ion-exchanged water (normal temperature (20° C. to 25° C.), pH 7.2) (1,000 parts by mass) was added to the filtration cake obtained in (1). The resultant was mixed using TK HOMOMIXER (at 12,000 rpm for 30 min) under an ultrasonic vibration, followed by filtrating under reduced pressure.

The thus obtained [toner base particle 25] was found to have the volume average particle diameter (Dv) of 5.3 vim, the number average particle diameter (Dn) of 4.7 the Dv/Dn of 1.11, and the average sphericity of 0.966.

[Developer 25] were obtained in the same manner as in Example 16 except the above.

Example 23

(1) In Example 16, 200 ppm of CELLULIZER CL (mixture of cellulase and glycerin, product of Nagase ChemteX Co., Ltd.) was added, heated to 60° C. and adjusted to have a pH of 8.1 with 10% by mass sodium hydroxide, followed by mixing using TK HOMOMIXER (at 12,000 rpm for 10 min) and filtrating.

(2) Ion-exchanged water (normal temperature (20° C. to 25° C.), pH 7.2) (1,000 parts by mass) was added to the filtration cake obtained in (1). The resultant was mixed using TK HOMOMIXER (at 12,000 rpm for 30 min) under an ultrasonic vibration, followed by filtrating under reduced pressure.

The thus obtained [toner base particle 26] was found to have the volume average particle diameter (Dv) of 5.7 μm, the number average particle diameter (Dn) of 5.3 μm, the Dv/Dn of 1.14, and the average sphericity of 0.966.

[Developer 26] were obtained in the same manner as in Example 16 except the above.

Example 24

(1) In Example 16, 200 ppm of CELLULIZER CL (mixture of cellulase and glycerin, product of Nagase ChemteX Co., Ltd.) was added, heated to 60° C. and adjusted to have a pH of 6.2 with 10% hydrochloric acid, followed by mixing using TK HOMOMIXER (at 12,000 rpm for 10 min) and filtrating.

(2) Ion-exchanged water (normal temperature (20° C. to 25° C.), pH 5.2) (1,000 parts by mass) was added to the filtration cake obtained in (1). The resultant was mixed using TK HOMOMIXER (at 12,000 rpm for 30 min) under an ultrasonic vibration, followed by filtrating under reduced pressure.

The thus obtained [toner base particle 27] was found to have the volume average particle diameter (Dv) of 5.5 μm, the number average particle diameter (Dn) of 5.1 μm, the Dv/Dn of 1.12, and the average sphericity of 0.964.

[Developer 27] were obtained in the same manner as in Example 16 except the above.

Example 25

(1) In Example 16, 200 ppm of CELLULIZER CL (mixture of cellulase and glycerin, product of Nagase ChemteX Co., Ltd.) was added, heated to 60° C. and adjusted to have a pH of 6.2 with 10% hydrochloric acid, followed by mixing using TK HOMOMIXER (at 12,000 rpm for 10 min) and filtrating.

(2) Ion-exchanged water (normal temperature (20° C. to 25° C.), pH 9.1) (1,000 parts by mass) was added to the filtration cake obtained in (1). The resultant was mixed using TK HOMOMIXER (at 12,000 rpm for 30 min) under an ultrasonic vibration, followed by filtrating under reduced pressure.

The thus obtained [toner base particle 28] was found to have the volume average particle diameter (Dv) of 5.6 μm, the number average particle diameter (Dn) of 4.9 μm, the Dv/Dn of 1.14, and the average sphericity of 0.967.

[Developer 28] were obtained in the same manner as in Example 16 except the above.

Example 26

(1) In Example 16, 50 ppm of CELLULIZER CL (mixture of cellulase and glycerin, product of Nagase ChemteX Co., Ltd.) was added, heated to 45° C. and adjusted to have a pH of 4.2 with 10% hydrochloric acid, followed by mixing using TK HOMOMIXER (at 12,000 rpm for 10 min) and filtrating.

(2) Ion-exchanged water (normal temperature (20° C. to 25° C.), pH 7.3) (1,000 parts by mass) was added to the filtration cake obtained in (1). The resultant was mixed using TK HOMOMIXER (at 12,000 rpm for 30 min) under an ultrasonic vibration, followed by filtrating under reduced pressure.

The thus obtained [toner base particle 29] was found to have the volume average particle diameter (Dv) of 5.4 μm, the number average particle diameter (Dn) of 4.9 μm, the Dv/Dn of 1.13, and the average sphericity of 0.967.

[Developer 29] were obtained in the same manner as in Example 16 except the above.

Example 27

(1) In Example 16, 100 ppm of CELLULIZER CL (mixture of cellulase and glycerin, product of Nagase ChemteX Co., Ltd.) was added, heated to 45° C. and adjusted to have a pH of 5.6 with 10% hydrochloric acid, followed by mixing using TK HOMOMIXER (at 12,000 rpm for 10 min) and filtrating.

(2) Ion-exchanged water (normal temperature (20° C. to 25° C.), pH 7.1) (1,000 parts by mass) was added to the filtration cake obtained in (1). The resultant was mixed using TK HOMOMIXER (at 12,000 rpm for 30 min) under an ultrasonic vibration, followed by filtrating under reduced pressure.

The thus obtained [toner base particle 30] was found to have the volume average particle diameter (Dv) of 5.4 the number average particle diameter (Dn) of 4.9 the Dv/Dn of 1.12, and the average sphericity of 0.970.

[Developer 30] were obtained in the same manner as in Example 16 except the above.

Example 28

(1) In Example 16, 400 ppm of CELLULIZER CL (mixture of cellulase and glycerin, product of Nagase ChemteX Co., Ltd.) was added, heated to 45° C. and adjusted to have a pH of 6.8 with 10% hydrochloric acid, followed by mixing using TK HOMOMIXER (at 12,000 rpm for 10 min) and filtrating.

(2) Ion-exchanged water (normal temperature (20° C. to 25° C.), pH 7.3) (1,000 parts by mass) was added to the filtration cake obtained in (1). The resultant was mixed using TK HOMOMIXER (at 12,000 rpm for 30 min) under an ultrasonic vibration, followed by filtrating under reduced pressure.

The thus obtained [toner base particle 31] was found to have the volume average particle diameter (Dv) of 5.3 μm, the number average particle diameter (Dn) of 4.8 μm, the Dv/Dn of 1.13, and the average sphericity of 0.969.

[Developer 31] were obtained in the same manner as in Example 16 except the above.

Example 29

(1) In Example 16, 200 ppm of CELLULIZER CL (mixture of cellulase and glycerin, product of Nagase ChemteX Co., Ltd.) was added, heated to 65° C. and adjusted to have a pH of 6.2 with 10% hydrochloric acid, followed by mixing using TK HOMOMIXER (at 12,000 rpm for 10 min) and filtrating.

(2) Ion-exchanged water (normal temperature (20° C. to 25° C.), pH 6.5) (1,000 parts by mass) was added to the filtration cake obtained in (1). The resultant was mixed using TK HOMOMIXER (at 12,000 rpm for 30 min) under an ultrasonic vibration, followed by filtrating under reduced pressure.

The thus obtained [toner base particle 32] was found to have the volume average particle diameter (Dv) of 5.4 μm, the number average particle diameter (Dn) of 4.8 μm, the Dv/Dn of 1.12, and the average sphericity of 0.965.

[Developer 32] were obtained in the same manner as in Example 16 except the above.

Comparative Example 4

(1) In Example 16, a cellulase-containing mixture was not added, heated to 45° C. and adjusted to have a pH of 6.2 with 10% hydrochloric acid, followed by mixing using TK HOMOMIXER (at 12,000 rpm for 10 min) and filtrating.

(2) Ion-exchanged water (normal temperature (20° C. to 25° C.), pH 6.5) (1,000 parts by mass) was added to the filtration cake obtained in (1). The resultant was mixed using TK HOMOMIXER (at 12,000 rpm for 30 min) under an ultrasonic vibration, followed by filtrating under reduced pressure.

The thus obtained [toner base particle 33] was found to have the volume average particle diameter (Dv) of 5.7 μm, the number average particle diameter (Dn) of 5.0 μm, the Dv/Dn of 1.15, and the average sphericity of 0.962.

[Developer 33] were obtained in the same manner as in Example 16 except the above.

Comparative Example 5

(1) In Example 16, a cellulase-containing mixture was not added, heated to 25° C. and adjusted to have a pH of 6.5 with 10% hydrochloric acid, followed by mixing using TK HOMOMIXER (at 12,000 rpm for 10 min) and filtrating.

(2) Ion-exchanged water (normal temperature (20° C. to 25° C.), pH 7.2) (1,000 parts by mass) was added to the filtration cake obtained in (1). The resultant was mixed using TK HOMOMIXER (at 12,000 rpm for 30 min) under an ultrasonic vibration, followed by filtrating under reduced pressure.

The thus obtained [toner base particle 34] was found to have the volume average particle diameter (Dv) of 5.2 μm, the number average particle diameter (Dn) of 4.9 μm, the Dv/Dn of 1.12, and the average sphericity of 0.963.

[Developer 34] were obtained in the same manner as in Example 16 except the above.

The toner particle dispersion liquids and the developers were evaluated by the methods described above. Results are shown in Tables 3-1 and 3-2.

TABLE 3-1

| | Added amount of cellulase mixture (ppm) | Heating temperature of toner particle dispersion liquid | Post-adjusted pH of toner particle dispersion liquid | pH of washing water | Viscosity of toner particle dispersion liquid (mPa · s) |
|---|---|---|---|---|---|
| Example 16 | 200 | 30 | 6.2 | 7.2 | 2.26 |
| Example 17 | 200 | 30 | 3.4 | 7.2 | 2.50 |
| Example 18 | 200 | 30 | 8.2 | 7.2 | 2.35 |
| Example 19 | 200 | 30 | 6.2 | 5.2 | 2.20 |
| Example 20 | 200 | 30 | 6.2 | 9.0 | 2.53 |
| Example 21 | 200 | 60 | 6.2 | 7.2 | 2.32 |
| Example 22 | 200 | 60 | 3.4 | 7.2 | 2.52 |
| Example 23 | 200 | 60 | 8.1 | 7.2 | 2.22 |
| Example 24 | 200 | 60 | 6.2 | 5.2 | 2.28 |
| Example 25 | 200 | 60 | 6.2 | 9.1 | 2.33 |
| Example 26 | 50 | 45 | 4.2 | 7.3 | 2.51 |
| Example 27 | 100 | 45 | 5.6 | 7.1 | 2.14 |
| Example 28 | 400 | 45 | 6.8 | 7.3 | 2.46 |
| Example 29 | 200 | 65 | 6.2 | 6.5 | 3.51 |
| Comparative Example 4 | None | 45 | 6.2 | 6.5 | 12.34 |
| Comparative Example 5 | None | 25 | 6.5 | 7.2 | 13.12 |

TABLE 3-2

| | | Toner properties | | | |
|---|---|---|---|---|---|
| | Filterability | Chargeability | Stress-resistant charge stability | Image smear | Heat-resistant storage ability |
| Example 16 | A | A | A | A | A |
| Example 17 | B | B | A | B | B |
| Example 18 | B | B | A | B | B |
| Example 19 | B | B | B | B | B |
| Example 20 | B | B | B | B | B |
| Example 21 | A | A | A | A | A |
| Example 22 | B | B | B | B | B |

TABLE 3-2-continued

| | Toner properties | | | | |
|---|---|---|---|---|---|
| | Filterability | Chargeability | Stress-resistant charge stability | Image smear | Heat-resistant storage ability |
| Example 23 | B | B | B | B | B |
| Example 24 | A | B | A | B | A |
| Example 25 | A | B | A | B | A |
| Example 26 | A | A | A | A | A |
| Example 27 | A | A | A | A | A |
| Example 28 | A | A | A | A | A |
| Example 29 | B | C | B | C | C |
| Comparative Example 4 | C | D | B | D | B |
| Comparative Example 5 | D | D | B | D | B |

Embodiments of the present invention are as follows:

<1> A toner, wherein the toner is obtained by washing a toner particle dispersion liquid which is obtained by adding cellulase to a dispersion slurry, and the dispersion slurry is obtained from a dispersion liquid or an emulsion of a toner material-containing oil phase in an aqueous medium, and wherein the dispersion liquid or the emulsion contains a cellulosic dispersion stabilizing agent.

<2> The toner according to <1>, wherein the toner particle dispersion liquid which is obtained by adding the cellulase to the dispersion slurry has a viscosity of 2.0 mPa·s to 9.5 mPa·s at 23° C.

<3> The toner according to <1> or <2>, wherein the toner particle dispersion liquid which is obtained by adding the cellulase to the dispersion slurry has a viscosity of 2.0 mPa·s to 5.0 mPa·s at 23° C.

<4> The toner according to any one of <1> to <3>, wherein the cellulase is contained at a concentration of 30 ppm to 400 ppm relative to an amount of the toner particle dispersion liquid.

<5> The toner according to any one of <1> to <4>, wherein the toner material contains a binder resin, wherein the binder resin contains at least two binder resins, and wherein the binder resin contains a modified polyester resin having a urethane group, a urea group, or both thereof.

<6> The toner according to <5>, wherein the polyester resin contains a modified polyester resin which has been chain-elongated or crosslinked by a reaction of an amine with a modified polyester resin having a terminal isocyanate group.

<7> A method for producing a toner including:

washing a dispersion slurry which is obtained from a dispersion liquid or an emulsion of a toner material-containing oil phase in an aqueous medium;

wherein the dispersion liquid or the emulsion contains a cellulosic dispersion stabilizing agent; and wherein the washing is performed after cellulase is added to the dispersion slurry.

<8> The method according to <7>, wherein the washing is performed after a toner particle dispersion liquid which is obtained by adding the cellulase to the dispersion slurry is heated to 30° C. to 60° C.

<9> The method according to <8>, wherein the toner particle dispersion liquid which is obtained by adding the cellulase to the dispersion slurry has a pH of 4 to 7.

<10> The method according to any one of <7> to <9>, wherein washing water used for the washing has a pH of 6 to 8.

<11> The method according to any one of <7> to <10>, wherein the toner particle dispersion liquid which is obtained by adding the cellulase to the dispersion slurry has a viscosity of 2.0 mPa·s to 9.5 mPa·s at 23° C.

<12> The method according to any one of <7> to <11>, wherein the toner particle dispersion liquid which is obtained by adding the cellulase to the dispersion slurry has a viscosity of 2.0 mPa·s to 5.0 mPa·s at 23° C.

<13> The method according to any one of <8> to <12>, wherein the cellulase is contained at a concentration of 30 ppm to 400 ppm relative to an amount of the toner particle dispersion liquid.

<14> A developer containing:

the toner according to any one of <1> to <6>.

This application claims priority to Japanese application No. 2012-196923, filed on Sep. 7, 2012 and incorporated herein by reference.

What is claimed is:

1. A method for producing a toner comprising:

washing a dispersion slurry which is obtained from a dispersion liquid or an emulsion of a toner material-containing oil phase in an aqueous medium;

wherein the dispersion liquid or the emulsion comprises a cellulosic dispersion stabilizing agent, wherein the amount of the cellulosic dispersion stabilizing agent is from 0.01% by mass to 1% by mass relative to the total amount of the aqueous medium; and wherein the washing is performed after cellulase is added to the dispersion slurry, and wherein the cellulase is contained at a concentration of 30 ppm to 60 ppm relative to an amount of a toner particle dispersion liquid.

2. The method according to claim 1, wherein the washing is performed after a toner particle dispersion liquid which is obtained by adding the cellulase to the dispersion slurry is heated to 30° C. to 60° C.

3. The method according to claim 2, wherein the toner particle dispersion liquid which is obtained by adding the cellulase to the dispersion slurry has a pH of 4 to 7.

4. The method according to claim 1, wherein washing water used for the washing has a pH of 6 to 8.

5. The method according to claim 2, wherein the toner particle dispersion liquid which is obtained by adding the cellulase to the dispersion slurry has a viscosity of 2.0 mPa·s to 9.5 mPa·s at 23° C.

6. The method according to claim 2, wherein the toner particle dispersion liquid which is obtained by adding the cellulase to the dispersion slurry has a viscosity of 2.0 mPa·s to 5.0 mPa·s at 23° C.

7. The method according to claim 1, wherein the cellulosic dispersion stabilizing agent is at least one selected from the group consisting of methylcellulose, hydroxyethylcellulose, hydroxypropylcellulose and carboxymethylcellulose.

* * * * *